US010773120B2

(12) United States Patent
St. Cyr

(10) Patent No.: US 10,773,120 B2
(45) Date of Patent: Sep. 15, 2020

(54) EXERCISE ROCKER

(71) Applicant: Aaron St. Cyr, Oklahoma City, OK (US)

(72) Inventor: Aaron St. Cyr, Oklahoma City, OK (US)

( * ) Notice: Subject to any disclaimer, the term of this patent is extended or adjusted under 35 U.S.C. 154(b) by 0 days.

(21) Appl. No.: 16/501,349

(22) Filed: Mar. 28, 2019

(65) Prior Publication Data

US 2019/0299052 A1 Oct. 3, 2019

Related U.S. Application Data

(60) Provisional application No. 62/761,603, filed on Mar. 31, 2018.

(51) Int. Cl.
*A63B 22/00* (2006.01)
*A63B 21/00* (2006.01)
(Continued)

(52) U.S. Cl.
CPC .... *A63B 22/0087* (2013.01); *A63B 21/00185* (2013.01); *A63B 21/22* (2013.01);
(Continued)

(58) Field of Classification Search
CPC ..... A63B 21/00058; A63B 21/00069; A63B 21/00072; A63B 21/00076; A63B 21/00185; A63B 21/068; A63B 21/15; A63B 21/159; A63B 21/22; A63B 21/4027; A63B 21/4029; A63B 21/4031; A63B 21/4033; A63B 21/4034; A63B 21/4041; A63B 21/4045; A63B 21/4049; A63B 22/0015; A63B 22/0017; A63B 22/0023; A63B 22/0025; A63B 22/0046; A63B 22/0076; A63B 22/0087; A63B 22/0089; A63B 22/18; A63B 22/20; A63B 22/201; A63B 22/203; A63B 22/208; A63B 2022/0033; A63B 2022/0079; A63B 2022/0082; A63B 2022/0084; A63B 2022/206; A63B 23/02; A63B 23/0205; A63B 23/0211; A63B 23/0216; A63B 23/0222; A63B 23/0233; A63B 23/035; A63B 23/03516; A63B 23/03525;
(Continued)

(56) References Cited

U.S. PATENT DOCUMENTS 2,714,507 A * 8/1955 Goodrich ..... A63B 22/0076 482/72
2,826,192 A * 3/1958 Mangas ..... A61H 1/0259 601/26

(Continued)

*Primary Examiner* — Gary D Urbiel Goldner
(74) *Attorney, Agent, or Firm* — Randal Homburg

(57) ABSTRACT

An exercise device focusing on core strengthening and development of abdominal and gluteal muscle groups provides a curved inner track which provides a rolling seat and a flat outer track providing a rolling leg support over which the legs of a user engage, positioning the body in a recumbent position, with contraction and extension of the abdomen of the user compelling the rolling seat and rolling leg support using a pelvic thrusting motion to strengthen and exercise lower back, abdominal, gluteal, quadriceps and hamstring muscles and to improve and refine a shape and condition of the muscle groups.

4 Claims, 7 Drawing Sheets

(51) Int. Cl.
*A63B 21/22* (2006.01)
*A63B 23/02* (2006.01)
*A63B 22/20* (2006.01)

(52) U.S. Cl.
CPC ..... *A63B 21/4033* (2015.10); *A63B 21/4045* (2015.10); *A63B 22/203* (2013.01); *A63B 23/0205* (2013.01); *A63B 2022/206* (2013.01); *A63B 2208/0238* (2013.01); *A63B 2210/50* (2013.01); *A63B 2225/09* (2013.01)

(58) Field of Classification Search
CPC . A63B 23/04; A63B 23/0405; A63B 23/0417; A63B 23/0482; A63B 23/0494; A63B 69/06; A63B 2069/062; A63B 2069/064; A63B 2069/066; A63B 2069/068; A63B 2208/0228; A63B 2208/0238; A63B 2210/00; A63B 2210/50; A63B 2225/09; A63B 2225/093
See application file for complete search history.

(56) References Cited

U.S. PATENT DOCUMENTS 2,855,200 A * 10/1958 Blickman ..... A63B 21/154 482/130
3,130,968 A * 4/1964 De Feen ..... A63B 23/00 482/132
4,043,552 A * 8/1977 Kerkonian ..... A63B 22/0087 482/96
4,149,713 A * 4/1979 McLeod ..... A63B 23/03533 482/101
4,706,953 A 11/1987 Graham
5,527,249 A 6/1996 Harris
6,413,192 B2 7/2002 Abelbeck
6,428,450 B1 * 8/2002 Ho ..... A63B 23/0211 482/130
6,926,650 B2 8/2005 Endelman
8,043,199 B1 * 10/2011 Barker ..... A63B 22/0023 482/132
9,586,079 B1 * 3/2017 Jones ..... A63B 21/4034
2004/0209749 A1 * 10/2004 Planit ..... A63B 21/0552 482/121
2008/0064577 A1 * 3/2008 Pederson ..... A63B 22/205 482/140
2010/0099542 A1 * 4/2010 Fernandez ..... A63B 22/0087 482/142
2012/0100973 A1 * 4/2012 Boland ..... A63B 22/14 482/142
2012/0115694 A1 * 5/2012 Chen ..... A63B 23/0227 482/142
2012/0115695 A1 * 5/2012 Watterson ..... A63B 23/0216 482/142
2012/0238419 A1 * 9/2012 Ho ..... A63B 22/201 482/131
2013/0095981 A1 * 4/2013 Chung-Ting ..... A63B 21/00069 482/66
2013/0109551 A1 * 5/2013 Ho ..... A63B 22/208 482/142
2013/0123083 A1 * 5/2013 Sip ..... A63B 23/0222 482/145
2014/0005006 A1 * 1/2014 Ho ..... A63B 23/0227 482/96
2014/0087931 A1 * 3/2014 Ho ..... A63B 22/205 482/142
2015/0202484 A1 * 7/2015 Lalaoua ..... A63B 21/023 482/127
2015/0367173 A1 * 12/2015 Ellis ..... A63B 22/205 482/127
2016/0199687 A1 * 7/2016 Ho ..... A63B 22/20 482/66
2017/0014667 A1 * 1/2017 Barnett ..... A63B 23/03525
2017/0014678 A1 * 1/2017 Lalaoua ..... A63B 21/0414
2018/0015324 A1 * 1/2018 Yeh ..... A63B 22/001
2018/0169457 A1 * 6/2018 Singh ..... A63B 21/00178

* cited by examiner

EXERCISE ROCKER

CROSS REFERENCE TO RELATED APPLICATIONS

Applicant claims the benefit of U.S. Provisional Patent Application No. 62/761,603, filed on Mar. 31, 2019, to the same inventor.

I. BACKGROUND OF THE INVENTION

1. Field of Invention

An exercise device focusing on core strengthening and development of abdominal and gluteal muscle groups provides a curved inner track which provides a rolling seat and a flat outer track providing a rolling leg support over which the legs engage, positioning the body in a recumbent position, with contraction and extension of the abdomen compelling the rolling seat and rolling leg support using a pelvic thrusting motion to strengthen and exercise lower back, abdominal, gluteal, quadriceps and hamstring muscles and to improve and refine the shape and condition of the muscle groups.

2. Description of Prior Art

A preliminary review of prior art patents was conducted by the applicant which reveal prior art patents in a similar field or having similar use. However, the prior art inventions do not disclose the same or similar elements as the present exercise device, nor do they present the material components in a manner contemplated or anticipated in the prior art.

In U.S. Pat. No. 6,413,192 to Abelbeck, an abdominal muscle training device is provided with a horizontal pedal system. U.S. Pat. No. 5,527,249 to Harris discloses a pushing and pulling machine utilizing the user's weight to provide resistance using a curved track and roller assembly, but does not involve the same dual action tracks, a separate seat member and a separate leg rest member operating on two independent tracks. In U.S. Pat. No. 6,926,650 to Endelman, a horizontal device which provides a resistance to a user with a head and foot end and a platform upon which the user lies, pushing and pulling against a plurality of springs. In another device, U.S. Pat. No. 4,706,953 to Graham, a horizontal platform upon which the user lies, uses arm movement to compel the sled up and down the frame against the user's body weight.

II. SUMMARY OF THE INVENTION

Strengthening the core muscle groups in the waist and low back using exercise equipment is the subject of many exercise machines. This can involve weight machines, rowing machines and other equipment intended to target these core muscle groups. In many instances where the exercise equipment involves weighted stress or resistance, many times the exercise use can result in injury or movement beyond the scope of the user's capability. It has been found that if the exercise is too strenuous, a user will simply discontinue use of the equipment and these machines end up being sold for pennies on the dollar at garage sales or simply discarded.

The intention of the present exercise device is to provide a low impact and non-injury device that uses a mild rocking motion similar to that involved in using a swing set or rocking chair, wherein weights and resistance are avoided and the user simply rocks back and forth using a pelvic thrusting motion repeatedly, resulting in an ample core workout with little or lessen impact. The present device offers a folding seat which has four wheels engaging and upward curved track and an elevated leg rest having four wheels engaging a separate horizontal track, with the motion of the pelvis during a rocking movement causing the chair to move forward and backward, with the elevated leg rest following the movement along the horizontal track to isolate the muscles required to move the chair and leg rest confined to the core muscle groups of the abdomen and lower back, with resulting exercise movement also including the gluteal, quadriceps and hamstring muscles and to improve and refine the shape and condition of the muscle groups.

III. DESCRIPTION OF THE DRAWINGS

The following drawings are submitted with this utility patent application.

FIG. 8 is a sectional view of the exercise rocker along sectional lines 8/8 of FIG. 3.

IV. DESCRIPTION OF THE PREFERRED EMBODIMENT

Figure 1:
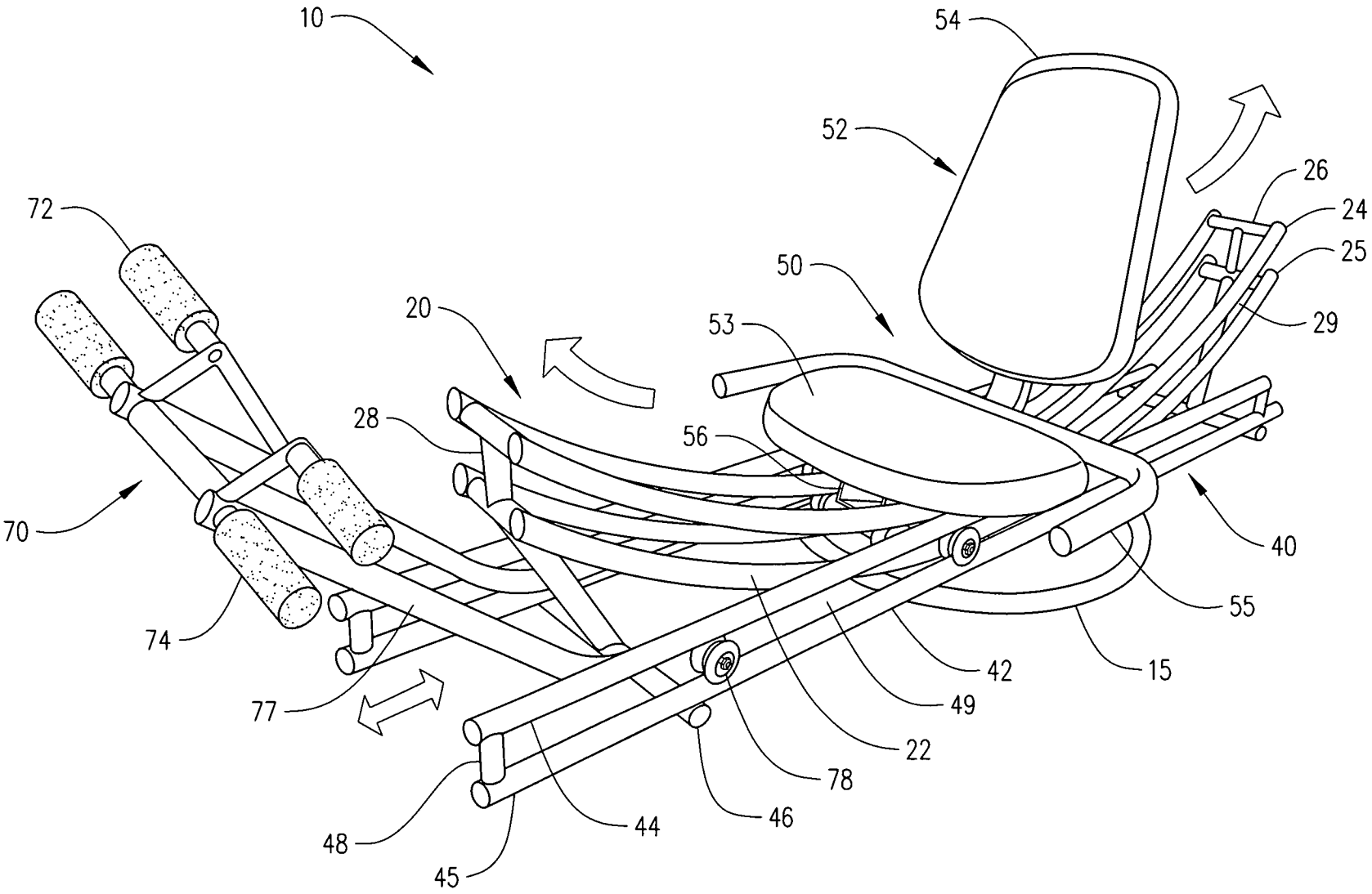
FIG. 1 is a front perspective view of the exercise rocker.
Figure 2:
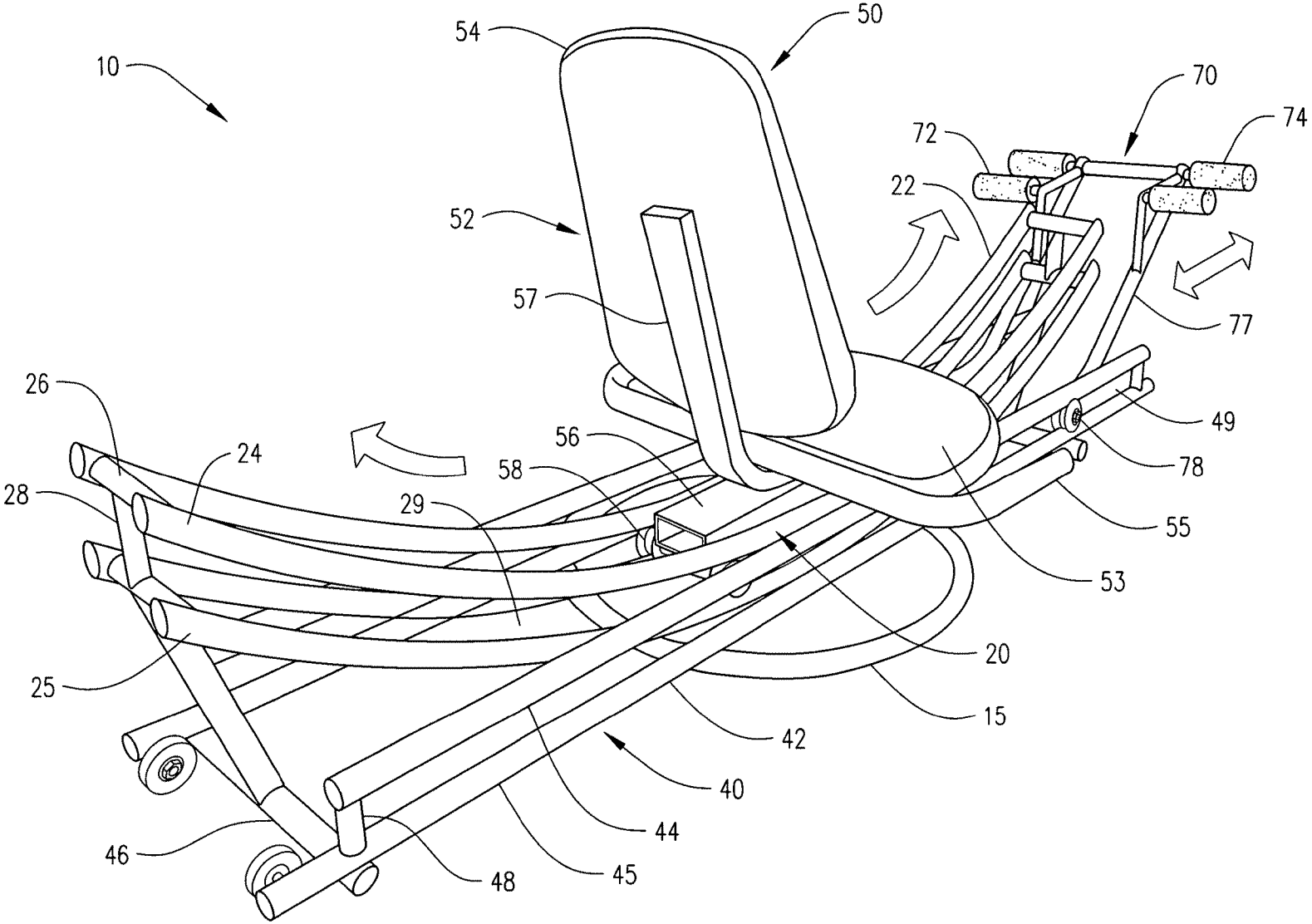
FIG. 2 is a rear perspective view of the exercise rocker.
Figure 3:
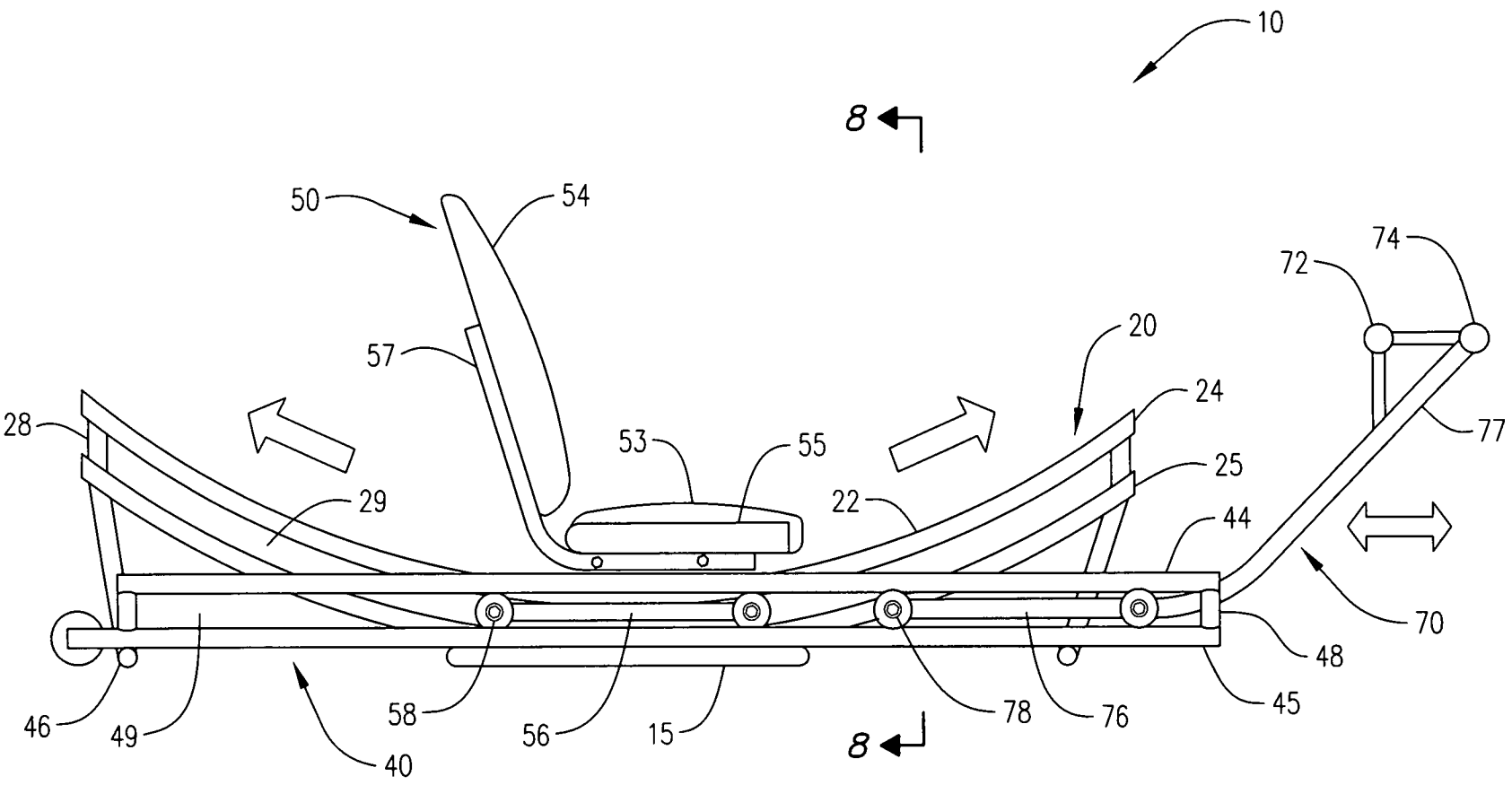
FIG. 3 is a side elevation view of the exercise rocker.
Figure 4:
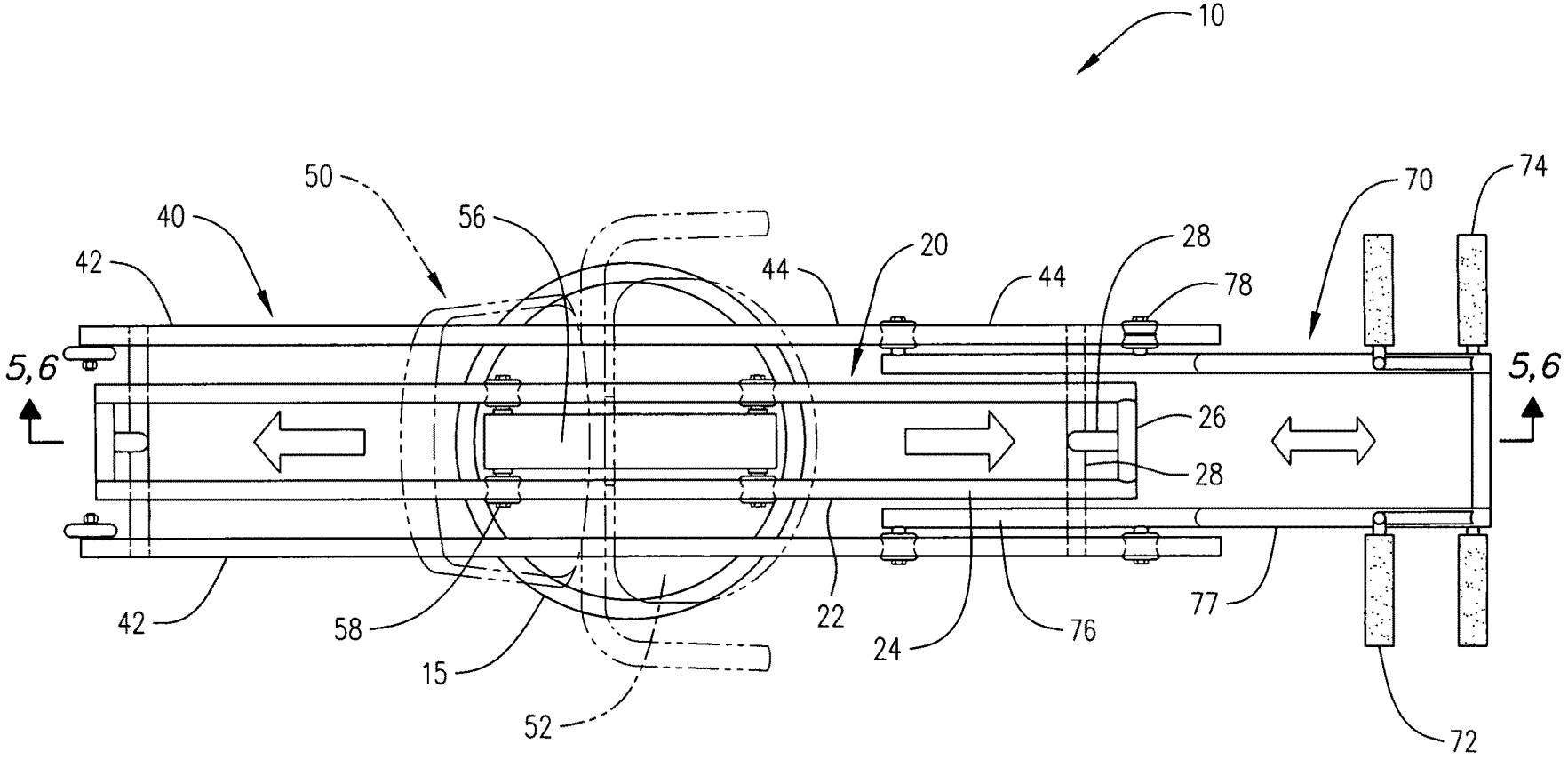
FIG. 4 is a top plan of the exercise rocker with phantom line indicating the chair and the cross members.

An exercise device 10, FIGS. 1-8, targeting the core muscle groups including the lower back, abdominal, gluteal, quadriceps and hamstring muscles and to improve and refine the shape and condition of the muscle groups, provides the device 10 having a seat member 50, defining a retractable chair 52 mounting upon a base frame 56 extending four lower wheels 58 including a right front, a left front, a right rear and a left rear, each wheel rotating within an upward curved track 20 defining two parallel segments 22, further having a lower elevated leg rest member 70, the lower elevated leg rest member 70 defining a frame 77, a knee bar 72 and a calf bar 74 upon which the user places their bent leg, the elevated leg rest member 70 further presenting a base 76 mounting four lower wheels 78, the four wheels including a right front, a left front, a right rear and a left rear, each wheel 78 rotating within a linear parallel lower track 40 defining two parallel segments 42, each segment 42 providing two parallel forward and backward pathways within the respective parallel segments 42, wherein the seat member 50 provides the user with a sitting platform while the bent legs of the user are placed over the lower elevated leg rest member 70, the user compelling the seat member 50 and lower elevated leg rest member 70 forward by extending the back and further compelling the seat member 50 and lower elevated leg rest member 70 backward by leaning forward, thereby providing movement compelled by a rocking motion of the user while situated upon the exercise device 10. The upward curved tracks 20 and parallel lower tracks 40 are commonly mounted upon a radial mounting brace, 15.

The seat member 50 further defines a contoured chair seat 53, a contoured chair back 54, and preferably arm rests 55, although the arm rests 55 are optional, FIGS. 1-8. The base 56 of the seat member provides the four wheels 58 in parallel alignment as shown in FIGS. 1-8, aligning the wheels 58 to provide forward and rear linear movement within the upward curved track 20. Likewise, the lower elevated leg rest member 70, FIGS. 1-8, further defines the knee bar 72 and a calf bar 74 upon which the user places their bent leg placing the bent knee over the knee bar 72 and the calf upon the calf bar 74, the user seated in a recumbent position while using the exercise device 10. The knee bar 72 and calf bar 74 are preferably padded and adjustable in distance and height using an adjustment means, not shown. The lower elevated leg rest member 70 may be retractable for compact storage when not assembled for use.

The upward curved track 20 and linear parallel lower track 40 respectively define a left and right segment 22, 42, including channel tracks which further define an upper rail 24, 44, and lower rail 25, 45, running parallel vertically and horizontally, forming respective wheel channels 29, 49, within which each respective left or right side wheels 58, 78, are secured, providing independent linear movement of each confined wheel 58, 78. These upper and lower rails 24, 25, 44, 45, are attached by a plurality of track cross-members 26, 46, to support and maintain parallel alignment of each set of tracks located within the separate upward curved tracks 20 and linear parallel lower track 40 as well as a plurality of vertical support members 28, 48, to further maintain the parallel integrity.

Figure 5:
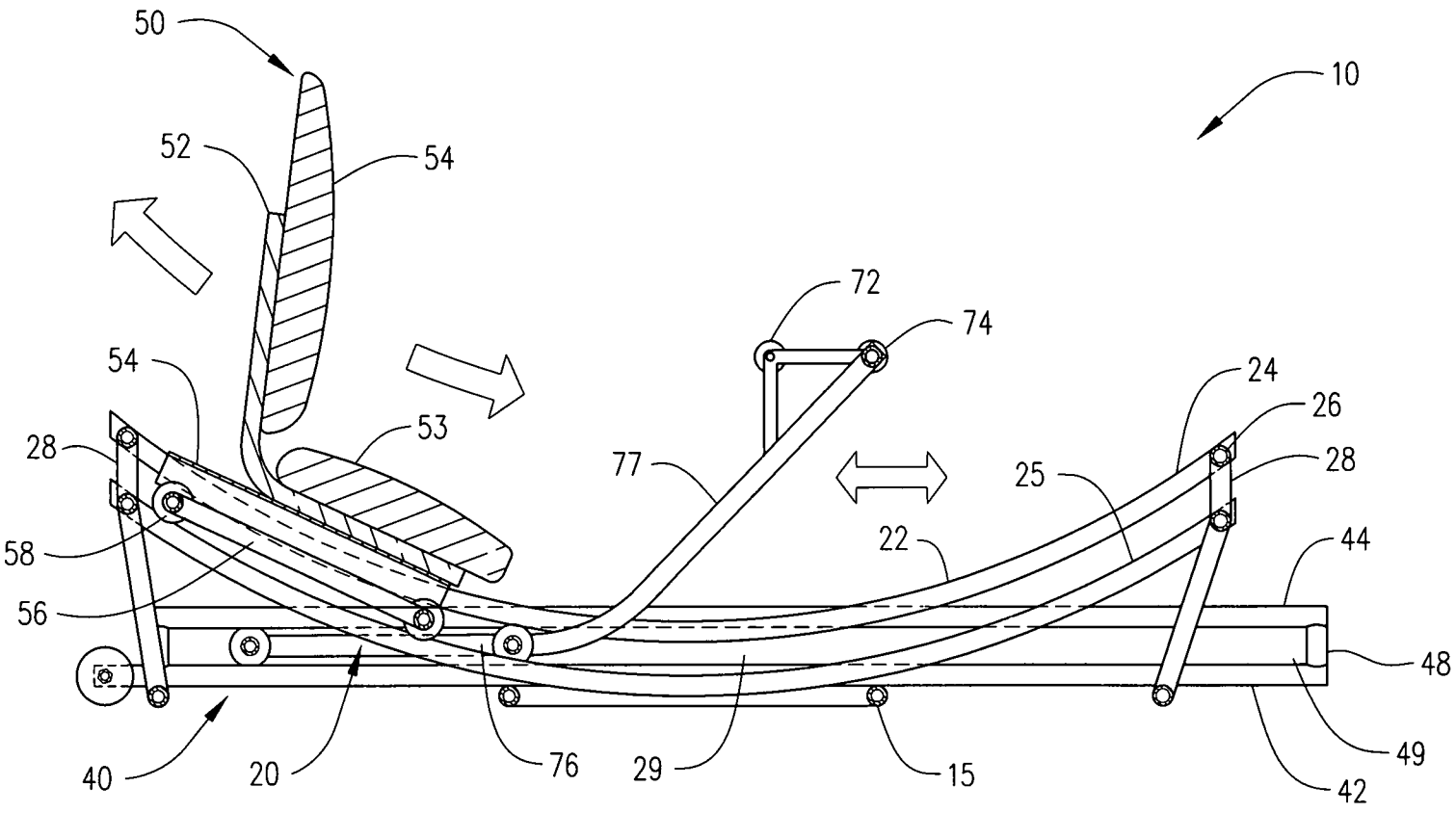
FIG. 5 is a side sectional view of the exercise rocker with the seat member and elevated leg member towards the rear of the exercise device along sectional lines 5/5 of FIG. 4.
Figure 3:
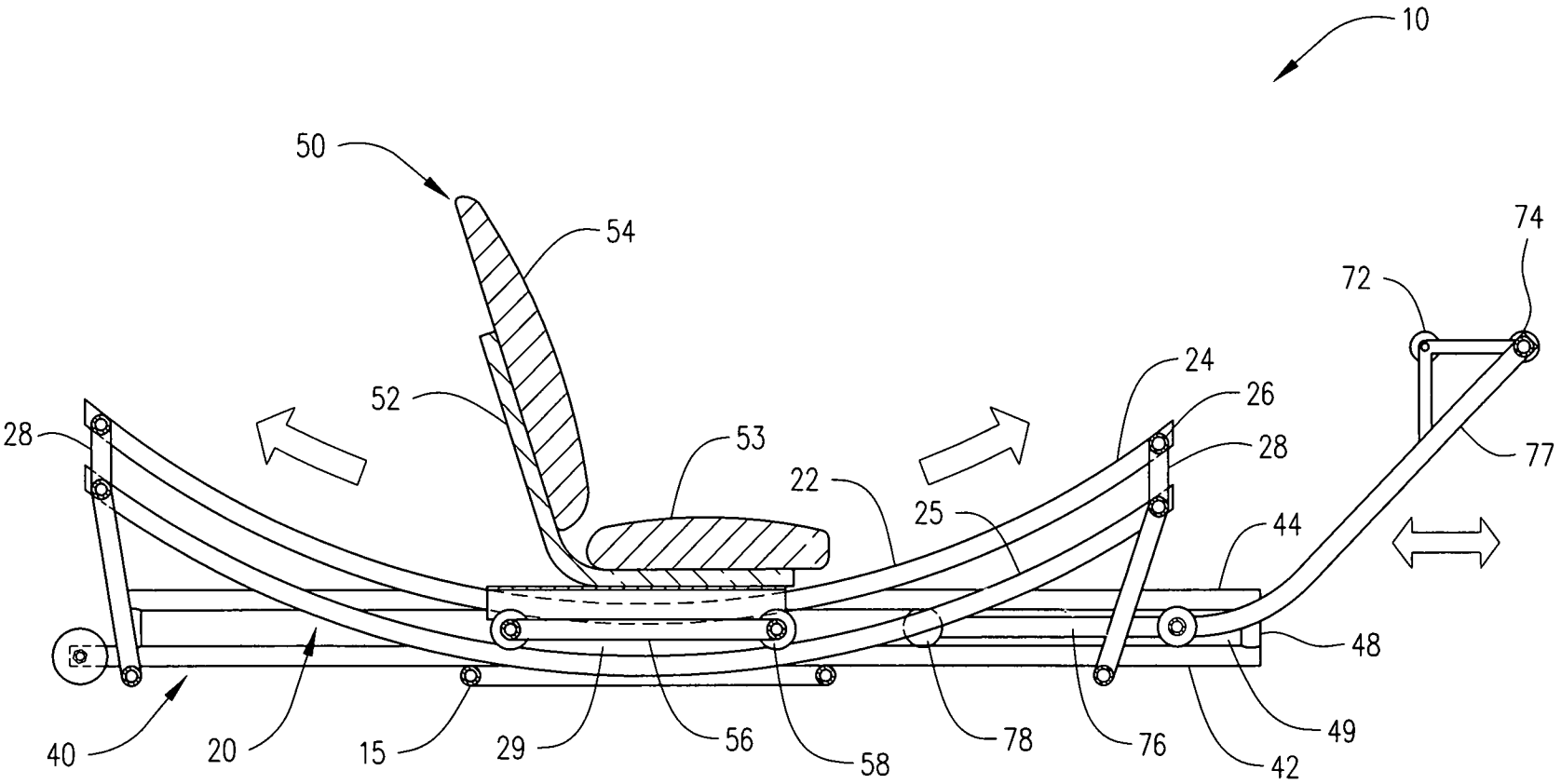
Figure 6:
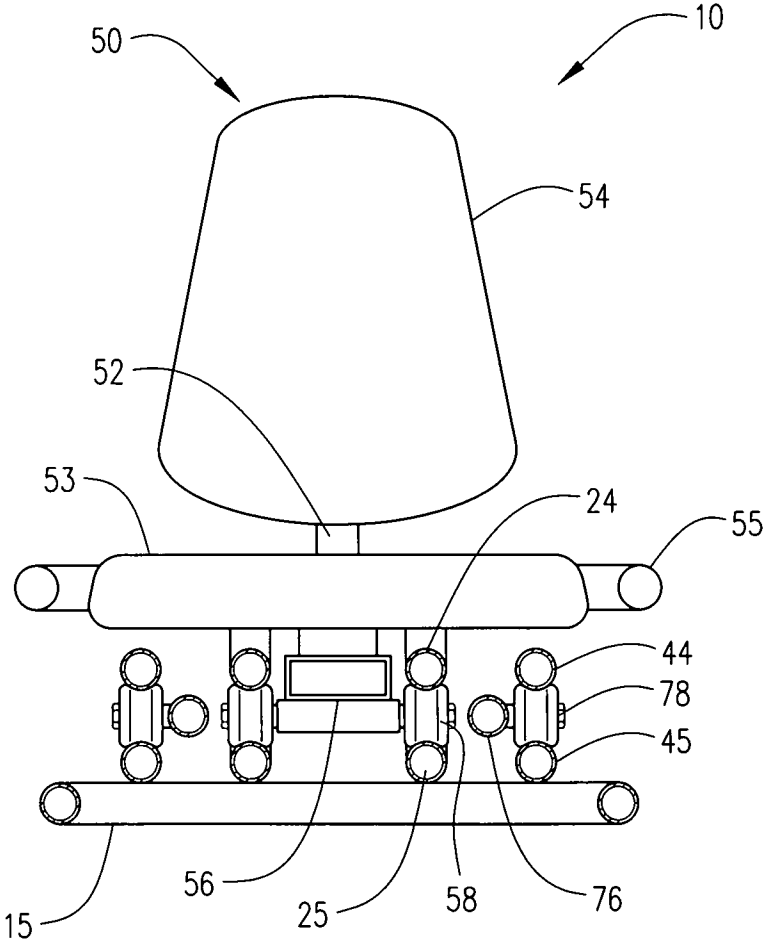
FIG. 6 is a sectional view of the exercise rocker along sectional line 6/6 of FIG. 4 with the seat member at the lowest point along the upward curved track.
Figure 7:
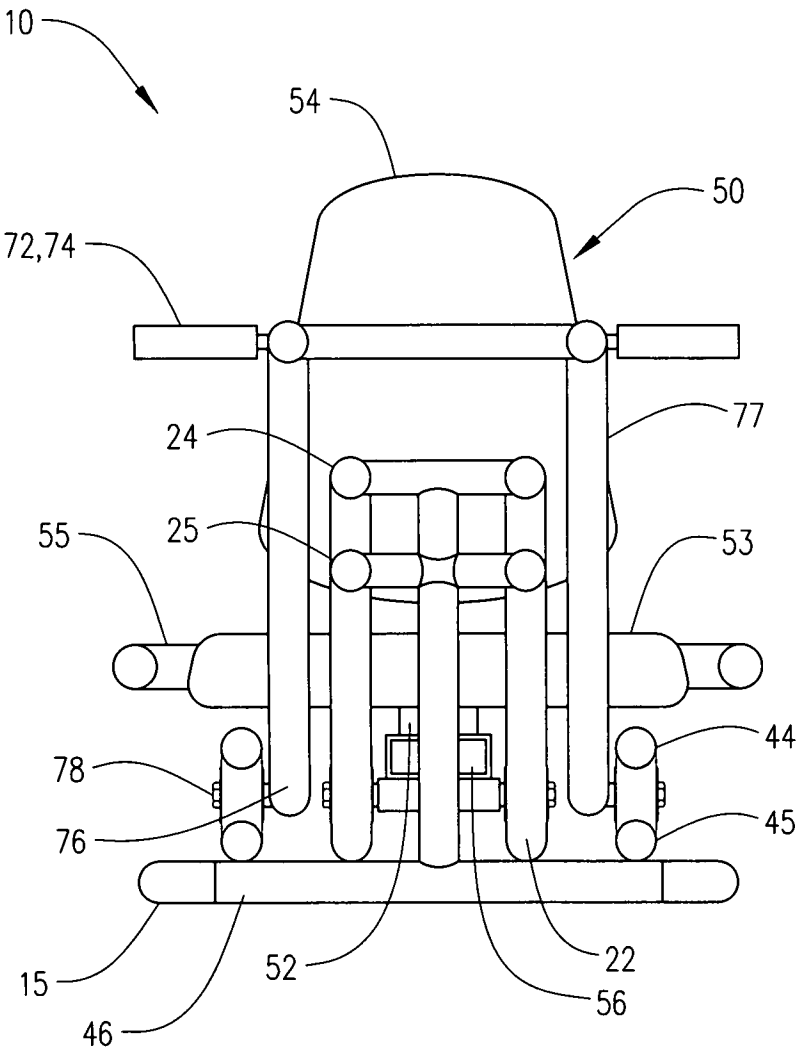
FIG. 7 is a front elevation of the exercise rocker.

Placement of the exercise device 10 would include locating the radial base plate 15 connecting the upward curved tracks 20 and the linear parallel lower tracks 40 on a flat surface, orienting the attached upward curved track at its lowest point, as best shown in FIGS. 1-8. The seat member 50 and lower elevated leg rest member 70 are then placed upon their respective tracks within their respective wheel channels 29, 49, as shown in FIGS. 1-8, with the knee bar 72 closest to the seat member 50. The user then sits upon the seat and places their legs as previously indicated, and commences the rocking motion, just as one would compel a swing, moving forward and backward by extension and retraction at the waist. Another element of motion is derived from the height differential of the user's upper torso and elevation of the legs upon the lower elevated leg rest member 70, where the legs are higher than the majority of the weight upon the seat member. A simple shift of the weight of the upper torso will urge the seat member 50 to move forward to distribute the weight of the user to a point where the weight seeks and distribution of equality at an apex with the body's position, with the seat member 50 and lower elevated leg rest member 70 being moved backwards on the return, as indicated in FIG. 5. It should not take a great deal of movement to commence movement of the exercise device 10 components along the track, and other items to assist movement may include bearings added to the respective wheels 58, 78, or upon axles attached to each frame member, handles located on the seat member, or other added elements to enhance, compel and sustain movement and other elements to provide resistance for enhanced progressive workouts. The user may chose to exercise for as long as they wish, halting movement by simply not rocking.

The exercise device 10, having four basic components, would provide for compact storage, disassembly of each component including the upward curved track, the linear parallel track, the seat member and the lower leg rest member, or collapsible or folding into a flat position for storage when not in use and deployed into an extended position for use. This can be accomplished through the addition of hinges, connector pins or other components to allow movement at any joint within the device. In addition to the embodiments shown in the drawing figures, the upward curved tracks may be located outside or inside the linear parallel lower tracks, with the drawings showing the embodiment where the upward curves tracks 20 are located inside the linear parallel lower tracks 40. And they may also constitute only one level of upward curved tracks 20, horizontally parallel and one level of linear parallel tracks 70 without requiring the upper set of corresponding vertically parallel placed tracks forming the wheel channels 29, 49, with the wheels simply riding on the single layer of respective tracks or rails.

While the invention has been particularly shown and described with reference to a preferred embodiment thereof, it will be understood by those skilled in the art that changes in form and detail may be made therein without departing from the spirit and scope of the invention.

What is claimed is:

1. An exercise device to improve and refine a shape and condition of a user, the exercise device comprising:

a radial base plate;

an upward curved track defining two first parallel side segments attached by at least one first cross member secured upon said radial base plate;

a linear parallel lower track defining two second parallel side segments attached by at least one second cross member secured upon said radial base plate;

a seat member defining a retractable chair, a first frame and a first base, said first base extending four wheels, said four wheels engaging said two first parallel side segments of said upward curved track allowing said seat member to roll forwards and backwards along said upward curved track; and a leg rest member defining a knee bar and a calf bar supported by a second frame and attached to a second base, said second base extending four wheels which engage said two second parallel side segments of said linear parallel lower track allowing said leg rest member to roll forwards and backwards along said linear parallel lower track, wherein said sear member and said leg member are configured for said user to be positioned thereupon in a recumbent seating position, and wherein said seat member and said leg rest member are configured to respectively move along said upward curved track and said linear parallel lower track by the user performing a rocking motion to perform as many torso crunch movements as desired to constitute a desired exercise.

2. The exercise device of claim 1, further comprising:

said seat member defining said retractable chair having a seat and a back attaching to said first frame; and said upward curved track further defining an upper rail and a lower rail on each said first parallel side segment, said upper and lower rails on each said first parallel side segment defining a wheel channel there between within which two of said four wheels attached to said seat member are correspondingly confined and with an ability to freely roll within each said respective wheel channel of said upward curved track.

3. The exercise device of claim 1, further comprising:

said leg rest member further defines said calf bar and said knee bar adjustably attaching to said second frame; and said linear parallel lower track further defining an upper rail and a lower rail on each said second parallel side segment, said upper and lower rails on each said second parallel side segment defining a wheel channel there between within which two of said four wheels attached to said leg rest member are correspondingly confined and with an ability to freely roll within each said respective wheel channel of said linear parallel lower track.

4. The exercise device of claim 1, further comprising:

said seat member defining said retractable chair having a seat and a back attaching to said first frame; and said upward curved track further defining an upper rail and a lower rail on each said first parallel side segment, said upper and lower rails on each said first parallel side segment defining a first wheel channel there between within which two of said four wheels attached to said seat member are correspondingly confined and with an ability to freely roll within each said respective first wheel channel of said upward curved track;

said leg rest member further defines said calf bar and said knee bar adjustably attaching to said second frame; and said linear parallel lower track further defining an upper rail and a lower rail on each said second parallel side segment, said upper and lower rails on each said second parallel side segment defining a second wheel channel there between within which two of said four wheels attached to said leg rest member are correspondingly confined and with an ability to freely roll within each said respective second wheel channel of said linear parallel lower track, independent from said four wheels of said seat member.

* * * * *